US005109638A

United States Patent [19]

Kime, Jr.

[11] Patent Number: 5,109,638

[45] Date of Patent: May 5, 1992

[54] ABRASIVE SHEET MATERIAL WITH NON-SLIP BACKING

[75] Inventor: Byron L. Kime, Jr., Bettendorf, Iowa

[73] Assignee: Microsurface Finishing Products, Inc., Wilton, Iowa

[21] Appl. No.: 322,574

[22] Filed: Mar. 13, 1989

[51] Int. Cl.[5] ..... B24D 11/00

[52] U.S. Cl. ..... 51/401; 51/406; 51/407; 51/293; 51/297

[58] Field of Search ..... 51/394, 398, 401, 406, 51/407, 328, 135 R, DIG. 5, 142, 293, 297, 298, 299

[56] References Cited

U.S. PATENT DOCUMENTS

| | | | |
|---|---|---|---|
| 1,255,525 | 2/1918 | Gardner . | |
| 1,994,604 | 3/1935 | Bohne | 474/251 |
| 2,899,288 | 8/1959 | Barclay | 51/293 |
| 3,136,614 | 6/1964 | Kuzmick | 51/297 |
| 3,229,425 | 1/1966 | Homeyer | 51/211 |
| 3,230,672 | 1/1966 | Anthon | 51/404 |
| 3,306,718 | 2/1967 | Chapin | 51/297 |
| 3,607,159 | 9/1971 | Haywood | 51/295 |
| 4,576,612 | 3/1986 | Shukla et al. | 51/407 X |
| 4,600,073 | 7/1986 | Honett | 180/9.1 X |
| 4,682,444 | 7/1987 | Judge et al. | 97/154 |

OTHER PUBLICATIONS

Sample of an "orange" abrasive material produced by 3M.

Sample of a "white" abrasive material produced by 3M.

Sample of abrasive material produced by Norton Company.

Brochure from The B. F. Goodrich Company concerning "Latexes-Hycar Acrylic, Hycar Nitrile, Geon Vinyl, Chloride, Good-rite Vinyl Pyridine, Good-rite Styrene-Butadiene".

*Primary Examiner*—M. Rachuba

*Attorney, Agent, or Firm*—Leydig, Voit & Mayer, Ltd.

[57] ABSTRACT

An improved coated abrasive material is provided with a thin backing layer of a gripper coating, preferably a resilient non-tacky material having a textured outer surface such as a veined stippling pattern. More particularly, a presently preferred embodiment includes a layer of a non-compressible material having an upper surface and a lower surface. At least one layer of a resilient binder material is provided in permanent, conforming engagement with the lower surface of the base layer. At least one adhesive layer of a resinous polymeric material coats and conforms to the binder layer. Additionally, at least one layer of finely divided abrasive particles are partially embedded in the adhesive layer.

23 Claims, 1 Drawing Sheet

ABRASIVE SHEET MATERIAL WITH NON-SLIP BACKING

BACKGROUND OF THE INVENTION

This invention relates to coated abrasive materials commonly used to smooth and polish a wide variety of materials including, for example, those made of wood, metal, plastic and glass. Coated abrasives may also be employed during manufacturing processes to shape and form a work piece, or to roughen and texture a work surface.

For example, coated adhesive materials are used in microfinishing apparatus such as that produced by Industrial Metal Products Corporation and disclosed in Judge et al., U.S. Pat. No. 4,682,444. This device has application in size control and is used among other things, for high tolerance shaping and polishing of engine crankshafts, camshafts and power transmission shafts.

As shown in Judge et al. (See also FIGS. 1 and 2 herein), a microfinishing device typically includes a polishing shoe assembly mounted on a moveable arm. A coated abrasive tape is threaded through the shoe and is held in compressive engagement against a segment of the work piece by rigid or flexible polishing shoe inserts. The work piece is then flooded with a liquid coolant and rotated in one or more directions. At the same time, the polishing shoe may be oscillated from side to side on the work surface. Each time the machine cycles to begin on a new operation, a portion of the coated abrasive tape is advanced to replace a portion of the previously used tape with a fresh, unused abrasive surface.

Several different operations may be accomplished using the above-described device. For example, in one stage, a freshly milled work piece may be treated with relatively coarse abrasive materials to bring the work piece into compliance with its design specifications, reduce irregularities in the work surface and otherwise reshape the work surface. In an additional stage, the work surface may be contacted with a very fine coated abrasive to polish and smooth the work surface and to eliminate any remaining marks or irregularities.

Various factors, such as the stability, movement and surface condition of the coated abrasive tape, as well as the shape and condition of the polishing shoe inserts, affect the success of this finishing process. In each of the above stages, the coated abrasive must be held firmly and securely in proper alignment with the work surface to ensure that the dimensions of the work piece are formed or maintained accurately and according to specification.

Any changes in the surface condition or geometry of the coated abrasive tape will adversely affect the microfinishing operation. In particular, if the coated abrasive tape or the polishing shoe inserts are out of alignment or contain irregularities such as bumps, grooves, ridges and the like, these misalignment and irregularities will create corresponding defects in the work surface. Such misalignments or irregularities may be caused, for example, by slippage of the coated abrasive tape, worn or misshapen polishing shoe surfaces, accumulated debris on the polishing shoe inserts, deformation of the abrasive tape, and debris falling between the face of the coated abrasive tape and the work piece.

These concerns, moreover, are not limited solely to microfinishing devices. In many applications, particularly those involving precise tolerances, coated abrasives should not possess undesirable irregularities and must be held firmly and securely in place to ensure the proper action of the coated abrasive without injury to the work surface. This is especially true where coated abrasives are exposed to adverse pressures, shear forces, frictional forces and temperatures, or where liquid coolants and the like may interfere with the securement and orientation of the coated abrasive.

THE PRIOR ART

Various prior art coated abrasive materials have been provided to attempt to address the above problems and requirements. For example, thin textured patterns of a hard polymer or adhesive material have been applied to a rear surface of coated abrasives to provide frictional engagement between holding means and the coated abrasive. In other prior coated abrasive products, abrasive materials have been placed on a rear surface to increase the frictional grip of holding means on the coated abrasive.

Each of these prior art products, however, present certain problems in use. Coated abrasives with a hard textured backing tend to move or slip against a holding means (such as polishing shoe inserts) damaging the rear surfaces of the coated abrasive material (causing more slippage), as well as the holding means and work surface.

Moreover, the hard texture of such a backing surface tends to erode the operative portions of the holding means. For example, in the above-described microfinishing device, the movement of a hard textured backing against the polishing shoe inserts erodes the shoe inserts changing their shape and geometry. The same is true of coated abrasives having an abrasive backing. As discussed above, erosion of such holding means may cause deleterious misalignment or irregularities in the abrasive sheet.

Furthermore, the hard textured backing of such products often fragments or scrapes off during use. This backing debris tends to collect at the leading or trailing edges of holding means (such as polishing shoe inserts) and, over time, these deposits actually cause bumps, pockets or other changes to the surface orientation of the abrasive material. This debris may also contaminate the work environment, causing further damage to the holding means and work piece.

Various measures may be taken to counter, in part, the deficiencies of the prior art. For example, holding means, polishing shoes and shoe inserts may be frequently cleaned or replaced. These and related practices, however, dramatically increase the cost and labor required to operate machinery using coated abrasive materials and further reduce the overall efficiency of such devices.

This invention overcomes the shortcomings of the prior art and provides an abrasive material that may be firmly secured in holding means such as, for example, those used in microfinishing devices. The coated abrasive of the invention moves little, if at all, during its use on a work piece. This coated abrasive, furthermore, will not abrade, erode or otherwise adversely effect the operative surfaces of holding means gripping the material. The coated abrasive of the invention also will not generate debris or detritus to accumulate on the holding means surface or contaminate the work environment.

SUMMARY OF THE INVENTION

It is an object of the invention to provide an improved coated abrasive material that may be firmly and releasably secured for use against a work surface.

It is also the object of the invention to provide an improved coated abrasive material that will not abrade, erode or otherwise adversely affect the operative surfaces of means used to position the material during use.

It is a further object of the invention to provide an improved coated abrasive material that will not generate undesirable debris or detritus during use.

It is a still further object of the invention to provide an improved coated abrasive material that may be used in microfinishing processes and machinery.

It is another object of the invention to provide an improved coated abrasive material that is simple and economical to produce and which is efficient, economical and convenient to use.

Further and additional objects will appear from the description, accompanying drawings and appended claims.

In accordance with an embodiment of the invention, an improved coated abrasive material is provided with a thin backing layer of a gripper coating, preferably a resilient non-tacky material having a textured outer surface such as a veined stippling pattern.

More particularly, a presently preferred embodiment includes a multi-layer laminate with at least one foundation or base layer of a non-compressible material having an upper surface and a lower surface. This base layer is preferably composed of a polymeric film material such as the polyethylene terephthalate (MYLAR) film produced by the E. I. du Pont de Nemours Company, with a thickness of 2 to 10 mils. At least one layer of a resilient binder material is provided in permanent, conforming engagement with the lower surface of the base layer. At least one adhesive layer of a resinous polymeric material coats and conforms to the binder layer. Additionally, at least one layer of abrasive particles are partially embedded in the adhesive layer.

Preferably, the binder layer, adhesive layer and abrasive material layer are provided in accordance with Anthon, U.S. Pat. No. 3,230,672 or by a product sold by Microsurface Finishing Products, Inc. under the trade name MICROMESH. Alternatively, the resilient binder material may be of a flexible polymeric material such as a latex material preferably 0.5 to 10 mils thick. The adhesive layer may be of a polymer resin such as a latex or other resinous adhesives and is preferably from 2 microns to 20 mils thick.

The abrasive particles may include silicon carbides, aluminum oxides, diamond, zirconia, flint glasses, garnet, emery or any other abrasive material. These particles may be of a variety of sizes depending on the desired grit or grade of coated abrasive material, although it may also be semi-tacky or tacky.

The base layer is further provided with at least one backing layer of a gripper coating, preferably a non-liquid resilient, non-tacky material which will releasably engage the holding means. The backing layer has an inner face in permanent, conforming engagement with the upper surface of the base layer and an outer face having a textured pattern applied thereto. This backing layer, like the binder layer, is preferably of a flexible polymeric material such as latex polymers with a preferred thickness of 2 to 5 mils.

The textured pattern applied to the outer face of the backing layer is preferably elevated 0.5 to 4 mils above the outer face. The preferred pattern includes figures of a stippled, random veined or "tree branch" design uniformly distributed across the outer face of the backing layer with approximately 50 to 150 mils between each vein figure.

The invention, in addition, is not limited to the above recited embodiments. Rather, it includes the further alternatives and variations shown in the drawings and discussed in the following description and claims and their equivalents.

DETAILED DESCRIPTION OF THE INVENTION

For a more complete understanding of the invention, reference should be made to the drawings wherein.

Figure 1:
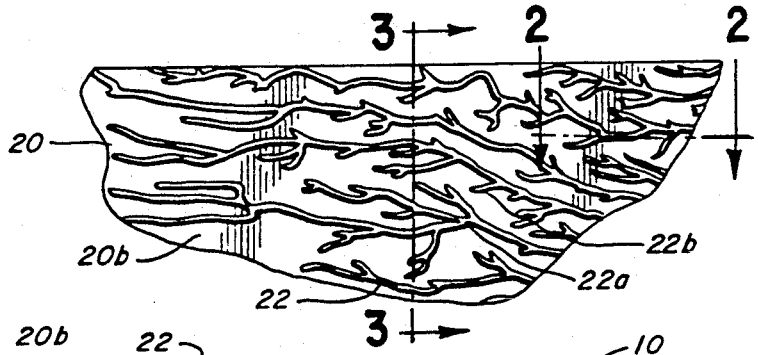
FIG. 1 is a top plan view of a coated abrasive material employing the teachings of the invention.
Figure 2:
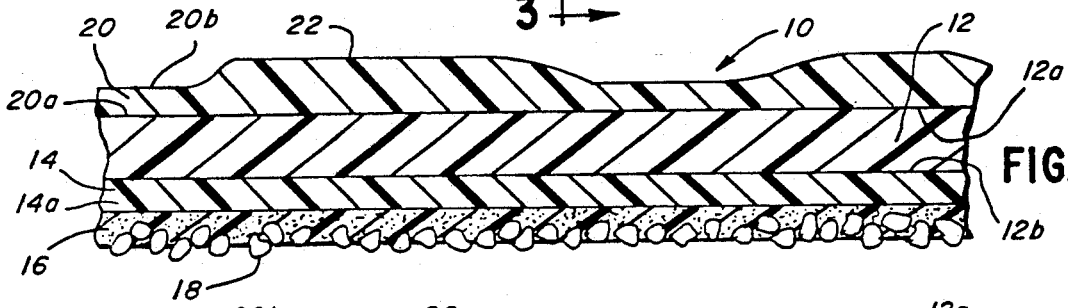
FIG. 2 is a schematic longitudinal section view of a segment of the coated abrasive material shown in FIG. 1, e.g. as taken along line 2—2 of FIG. 1.
Figure 3:
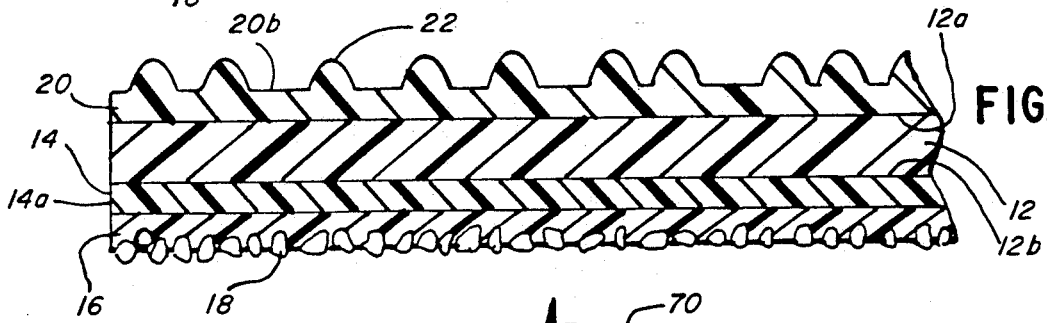
FIG. 3 is a sectional view of the segment of FIG. 1, e.g. as taken along line 3—3 of FIG. 1.
Figure 5:
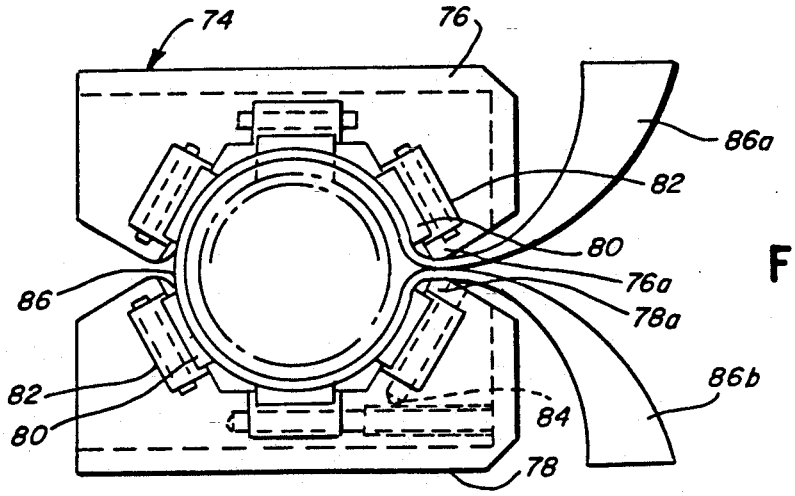
FIG. 5 is a sectional view of a polishing shoe assembly used in a microfinishing device.

Referring now to the drawings and more particularly to FIGS. 1, 2, and 3, one embodiment of the invention includes a multi-layer laminate coated abrasive 10 which, for example, may be a so-called tape of relatively narrow width and indeterminate length, as for use in a microfinishing device such as that shown in FIG. 5. The sheet 10 includes at least one foundation or base layer 12 of a non-compressible material having an upper surface **12*a* and a lower surface 12*b*. At least one layer of a resilient binder material 14 is adhered to the lower surface 12*b* of the base layer in permanent, conforming engagement with that lower surface. At least one layer 16 of a resinous adhesive material conforms and is adhered to the outer surface 14*a* of the binder layer. Partially embedded in the adhesive layer 16 is a layer of abrasive particles 18**.

At least one thin backing layer 20 of a gripper coating, preferably a non-liquid, resilient, non-tacky material, is provided on the opposite face **12*a* of the base, to be exposed as the gripping surface when the sheet 10 is in use with holding means. This backing layer includes an inner face 20*a* in permanent, conforming engagement with the upper surface 12*b* of the base layer and an outer face 20*b* provided with a textured pattern 22** on its surface.

The foundation or base layer 12 provides the basic integrity, tensile strength and dimensional stability of the sheet 10. In the illustrated preferred embodiment, the base layer 12 is composed of a flexible, tough, inelastic polymeric film material such as a polyethylene terephthalate (MYLAR) film produced by the E. I. du Pont de Nemours Company. Other polymers, copolymers, composites, fabrics, treated papers or other inelastic, non-compressible materials may also be used, as long as the material provides the dimensional stability required in a coated abrasive sheet. Depending on the application, such materials also should have a relatively high tensile strength, high shear strength, and good creep resistance.

The thickness of the base layer is preferably in the range of about 2 to 10 mils although other thicknesses may be used. This thickness may be adjusted depending on the particular application. For example, should the invention be used in the initial shaping and forming stages of a microfinishing process, a relatively thick base layer may be desired to provide additional rigidity, strength and stability to the material. Similarly, the other dimensions (width, length etc.) of the sheet may vary depending on the particular application.

The resilient binder layer, the adhesive layer and the abrasive layer are preferable provided in accordance with Anthon, U.S. Pat. No. 3,230,672, incorporated herein by reference. Alternatively, a product from Microsurface Finishing Products, Inc. sold under the name MICROMESH may also provide these layers, particularly in the form of a MICROMESH product having a backing layer of polyethylene terepthalate film or a similar material.

The resilient binder material 14 may also be of a flexible polymeric material such as a latex polymer or other polymers, copolymers, composites, foams, papers or the like. It is believed that the binder layer acts, in part, as a substrate intermediate the base layer 12 and the adhesive layer 16 to provide improved bonding surfaces (14*a* and 14*b*) for the base and adhesive layers. Thus, the material used for the binder layer may vary depending on the nature of the particular base layer or adhesive layer.

The binder layer is preferably 0.5 to 10 mils thick and other thickness may also be used depending on the application. The binder layer may be applied to the base layer using any coating means known in the art and, similarly, may be leveled to the proper thickness with leveling means known in the art.

It is believed that the resiliency of the binder layer provides cushioning support for the abrasive particles 18 allowing the particles to rotate, shift and flex somewhat when applied against a work surface. In this regard, reference is made to Anthon, U.S. Pat. No. 3,230,672. The thickness of the binder layer may be increased or decreased depending on the degree of the cushioning support desired.

The adhesive layer 16 is preferably of polymeric resins such as latexes or other resinous adhesive materials. The composition of the adhesive layer may also be varied depending on the abrasive particles used, the composition of the base and binder layers, the expected operating conditions and other similar considerations.

The adhesive layer is preferably 2 microns to 20 mils thick, albeit other thicknesses may also be used depending on the grit of the abrasive particles used and the particular application. The adhesive layer may also be applied as a coating which is then leveled to the proper thickness. Alternatively, the adhesive layer may be entirely omitted and the abrasive particles 18 may be partially embedded directly into the binder layer 14 or base layer 12.

Appropriate abrasive particles 18 include silicon carbides, aluminum oxides, diamond, zirconia, flint glasses, garnet or emery as well as other abrasive materials such as fibrous materials, ceramics, or any other abrasive material. These abrasive particles 16, are embedded in a substantially uniform distribution across the surface of the adhesive layer 14.

The abrasive particles 18 may be of a variety of sizes depending on the desired grade of coated abrasive sheet desired. In the preferred embodiment, the cushioning effect of the binder layer 14 allows the use of a larger particle than is normally employed to produce a particularly fine grade of coated abrasive. For example, particles of an average size of 16 microns are typically used to produce a 600 grit coated abrasive sheet. In the preferred embodiment, particles with an average size of 50 microns will produce the same grade of abrasive.

The backing layer 20 is of a gripper coating, preferably a non-liquid, resilient, flexible polymeric material such as the previously mentioned latex polymers. Of course, other resilient, flexible polymers, copolymers, composites, foams, treated papers or the like may also be used. When latex polymers are used, they preferably have a glass transition temperature (Tg) of between −15 to −3 degrees centigrade. Glass transition temperatures reflect the relative softness of hand, low temperature flexibility and room temperature hardness of materials within a polymer group.

The backing layer 20 may be applied to the base layer 12 with well known coating processes and leveled (if necessary) with a doctor blade or other such leveling devices to a preferred thickness of 2 to 5 mils. This thickness may be increased or decreased depending on the particular holding means, pressures, temperatures, coolants and such other conditions under which the abrasive sheet is to be used.

The backing layer material should also be sufficiently formable during or after the coating process (whether in a liquid, semi-liquid or softened state) to cooperate with the means discussed below for forming a textured pattern on the backing layer's outer face 20*b*. This includes products retaining flowability during manufacture to serve as a reservoir of material for reforming the backing into, for example, a raised textured or stippled surface pattern.

The backing layer 20 also may be reinforced with fibers, fiber cloth, mesh or similar materials. Such a reinforced resilient backing material may, in fact, be used to replace both the base layer and binder layer. In such an embodiment, the adhesive and abrasive material would be applied directly to the inner face of the backing layer.

In the preferred embodiment, the outer face 20*b* of the backing layer is non-tacky when manufacture is completed and is releasably engageable with holding means mounted on the devices utilizing the coated abrasives of this invention. Depending on the application and the particular holding means, the outer face 20*b* may, alternatively, have a semi-tacky or tacky surface. This property may be inherent in the backing layer material or may be provided by a coating of an adhesive or similar material which will separate from the backing layer or remain on the holding means.

In such embodiments it may be appropriate to apply an additional protective layer of strippable material, such as a removable parting ribbon or tape, to protect the semi-tacky or tacky surface during the handling and storage of the coated abrasive material. Such an added protective layer would be removed prior to or in the course of use of the coated abrasive.

As shown in FIGS. 1, 2, and 3, in the preferred embodiment, the outer exposed portion or outer face 20*b* of the gripper backing layer is provided with a textured pattern 22 comprising small raised ribs substantially uniformly distributed across the outer face 20*b* of the gripper coating. The illustrated pattern is of a random veined stippling, resulting in a "tree branch" design, which is obtained with one simple economic applicator technique referred to further below.

This pattern has a "stem" element 22a and an outwardly extending "arm" element 22b. In a preferred embodiment, the ribs of this pattern rise about 2 to 5 mils above the outer face 20b of the backing layer, with an average spacing of about 50 to 150 mils between these ribs across the width of the coated abrasive, etc. as seen in FIG. 3. This textured pattern design preferably makes up approximately 10% of the total surface area of the outer face 20b, although it may be more or less depending on the application.

The height or depth of the textured pattern relative to outer face 20b may also be varied depending on the application and the nature of the backing layer. Although, if the differential in elevation is too great, the effectiveness of the backing layer with respect to frictional gripping engagement with holding means in an application may be significantly reduced. This differential in elevation may vary depending on the material used.

Other elevated designs, recessed designs or combinations of designs may also be used depending on the holding means and operating conditions. The textured patterns may be both uniform or non-uniform, and they may be distributed across the surface of the outer face 20b in a regular or irregular design.

The textured pattern may also include designs that change across the width or length of the coated abrasive. However, in all instances, the depth and spacing of the texture pattern elements must be sufficiently small to avoid imposition of that pattern through the product to the abrasive working surface in a manner to deleteriously affect the uniformity of the abrasive or polishing action at the working interface between the abrasive surface and the work piece.

The textured pattern may be applied to the outer face 20b following any of the prior art methods for producing a textured surface, including printing process or techniques. For example, the veined or tree branch design may be produced by compressively engaging the outer face 20b of a layer of latex with a closed-cell foam covered texture roller soon after the backing layer is applied to the base layer, while the latex is still tacky and flowable. The position of the texture roller may be adjusted depending on the drying rate and flowability of the latex and the desired pattern.

EXAMPLES

Figure 4:
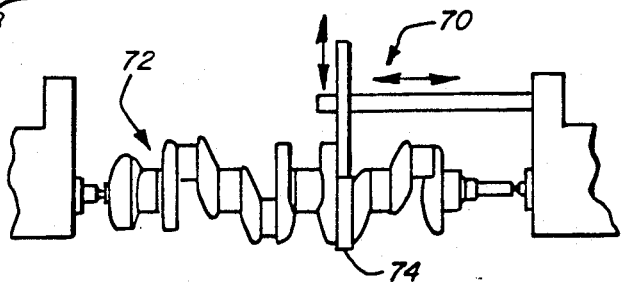
FIG. 4 is side view of a rotating crankshaft being worked by a microfinishing device.

FIGS. 4 and 5 show one example of the invention as used in a microsurfacing apparatus 70, similar to those produced by Industrial Metal Products Corporation; see also the aforementioned U.S. Pat. No. 4,682,444. FIG. 4 shows the microfinishing apparatus in position over one portion of a crankshaft work piece 72. One view of the polishing shoe 74 of the apparatus as shown in FIG. 5 with an upper shoe 76 and a lower shoe 78 in a closed position. The upper and lower shoes are provided with "honing stone" inserts 80 mounted in holders 82 which are held in place by mounting pins 84.

A coated abrasive tape 86 in accordance with this invention is disposed within the polishing shoe as a loop having a leading segment 86a and a trailing segment 86b extending from the polishing shoe. The leading segment 86a attaches to a takeup reel (not pictured) for advancing the used portions of the tape 86 to a roll means for convenient disposal. The trailing segment 86b of the tape attaches to a supply roll (not pictured) of fresh, unused coated abrasive tape material.

When, as shown in FIG. 5, the upper and lower polishing shoes are in a closed position, the stone inserts 80 releasably engage the coated abrasive tape 86 thereby compressing the tape against the work surface of the work piece 72. The leading segment 86a and trailing segment 86b are also compressively engaged by clamping edges 76a and 78a. Typically, the pressure applied against the coated abrasive sheet and work piece is approximately 30 to 150 pounds per square inch.

The work surface is then flooded with a liquid coolant, and the work piece is rotated in a first direction and then is rotated in a second opposite direction. The typical speed of rotation is 70 revolutions per minute. The polishing shoe may also be oscillated longitudinally of the work piece to further treat the work surface.

When the finishing of the work surface is complete, the polishing shoes are moved to an open, disengaged, position and the work piece 72 is removed from, or advanced through the polishing shoe. While the polishing shoe is open, a portion of the coated adhesive sheet 86 is indexed forward a sufficient distance advance a portion of the fresh, unused trailing segment into the polishing shoe.

EXAMPLE ONE

One example of an embodiment of the invention used to finish a work piece is a tape 10 of a MICROMESH abrasive sheet material having a binder layer 14 and adhesive layer 16 with abrasive particles 18 partially embedded therein, and a base layer 12 of polyethylene terephthalate film having a thickness of approximately 5 mils. Abrasive particles 18 of silicon carbide crystals were used with an average size of 50 microns to produce an approximately 600 grit abrasive surface.

The base layer was further provided with a backing layer 20 of resilient, flexible latex polymer having a thickness of approximately 2 mils. A texture 22 elevated to a height of approximately 2 mils was applied to the outer face of the backing layer to produce the "tree branch" pattern described above. The average cross-tape spacing between the tree "stems" was approximately 100 mils, and the pattern was relatively uniformly distributed across the face of the backing layer.

When this coated abrasive tape was employed in a microfinishing device to polish and shape a rotating work piece, the work piece was rotated at speeds of 30 to 70 rpms using a water-soluble liquid coolant. The pressure applied by the polishing shoe was initially 30 psi and was progressively increased to 150 psi.

It was determined that the coated abrasive tape accurately and efficiently completed the microfinishing operation with no appreciable slippage or movement between the polishing shoe inserts and the tape. Thus, the tape maintained its non-slip character throughout the range of rotational speeds and pressures used in the test. Moreover, the backing layer of the tape did not fracture, chip, or otherwise deteriorate. Nor did the backing layer abrade or erode the polishing shoe inserts or otherwise release debris during its use or during the movement of the tape through the polishing shoe. Accordingly, there was no buildup of backing material or other substances on the surfaces of the polishing shoe inserts or elsewhere in the work environment.

EXAMPLE TWO

A coated abrasive tape was prepared from the same materials and with dimensions similar to the tape of Example One above. This tape sample, however, was not provided with a textured pattern on the outer face of the backing layer.

When this tape sample was used in the previously mentioned microfinishing device, significant slippage occurred between the tape and the polishing shoe inserts. This tape was consequently deemed unacceptable for use in the subject microfinishing applications. That sample, however, was not tested in other applications. Similarly, the necessity of a textured backing layer in samples composed of other materials having other dimensions and characteristics was not evaluated.

It is believed that one possible explanation for the effectiveness of the material of Example One is that the small low raised elements in the thin resilient gripper coating provide relatively uniformly dispersed areas of concentrated contact pressure between the resilient backing and the polishing shoe inserts while maintaining substantially uniform support for the sheet throughout its area. It is believed that this affords improved mechanical or adherent interbonding of the sheet to the holding means in the higher-pressure areas without adversely affecting the distributed pressure at the working interface between the abrasive sheet and the work piece.

Thus, the invention provides a coated abrasive material that may be firmly, reliably and releasably held in operating position against a work piece simply by frictional engagement with the conformation-defining holding means (e.g., polishing shoe inserts) under normal operating pressures without adversely effecting the operative surfaces of the holding means or the work surface. The invention, furthermore, will not generate undesirable debris or detritous and is convenient, efficient and economical to manufacture and use.

While the invention has been described by reference to certain specific descriptions and examples which illustrate preferred materials, configurations and conditions, it is understood that the invention is not limited thereto. Rather, all alternatives, modifications and equivalents within the scope and spirit of the invention so described are considered to be within the scope of the appended claims.

I claim:

1. An improved indexable coated abrasive material for selective indexing movement along holding means, said material comprising a thin, flexible, non-compressible, non-stretchable, generally planar sheet having abrasive particles affixed to and exposed on a first major surface thereof, and a separate non-liquid layer of a resilient gripper material substantially covering and affixed to an opposite second major surface of said sheet; said layer of gripper material presenting an outwardly exposed, readily releasable gripping surface for frictionally and releasably engaging said holding means when said holding means are pressed against said exposed surface during use of said abrasive sheet and for ready release from said holding means for slidable selective movement of said abrasive sheet relative to said holding means when the engagement pressure therebetween is released.

2. The invention as in claim 1 wherein said layer of resilient gripper material is a thin coherent continuous layer of a resiliently compressible, semi-tacky material.

3. The invention as in claim 1 wherein said layer of resilient gripper material is a thin coherent continuous layer of a resiliently compressible, non-tacky material.

4. The invention as in claim 3 wherein said coating is of a thickness between about 2 to 5 mils.

5. The invention as in claim 1 wherein said layer of resilient gripper material consists essentially of a latex.

6. The invention as in claim 5 wherein said latex has a glass transition temperature of between −15 to 31 3 degrees centigrade.

7. The invention as in claim 1 wherein said abrasive particles are affixed to said first major surface by a substantially insoluble resinous adhesive material.

8. The invention as in claim 7 wherein said abrasive particles are partially and substantially permanently embedded in said resinous adhesive.

9. The invention as in claim 1 wherein said abrasive particles comprise a finely divided material suitable for polishing surfaces.

10. The invention as in claim 1 including a resiliently layer extending over and bonded to said first major surface of said sheet, a layer of substantially insoluble adhesive region on the distal surface of said last mentioned resilient layer and said abrasive particles being bonded substantially permanently in said adhesive resin.

11. The invention as in claim 10 wherein said abrasive particles are fine particles for polishing.

12. The invention as in any of claims 2–5 or 7–11 wherein said layer of resilient gripper material includes an outer portion consisting of a pattern of resilient raised elements substantially uniformly distributed over the exposed surface of such layer.

13. The invention as in claim 1 wherein said layer of resilient gripper material includes an outer portion consisting of a pattern of resilient raised elements substantially uniformly distributed over said exposed surface of said layer.

14. The invention as in claim 13 wherein said raised elements are ribs.

15. The invention as in claim 13 wherein said raised elements are randomly distributed over said exposed surface of said layer of resilient gripper material.

16. The invention as in claim 13 wherein said raised elements comprise randomly distributed interconnected ribs.

17. The invention as in claim 13 wherein said abrasive material comprises a long narrow strip and the average center-to-center cross-strip spacing between said raised elements is from 50 to 150 mils.

18. The invention as in claim 13 wherein the pattern of raised elements is elevated to 2 to 5 mils above said exposed surface of said layer of resilient gripper material.

19. The invention as in claim 13 wherein the raised elements comprise at least 10% of the total area of said exposed surface of said resilient gripper layer.

20. The invention as in claim 13 wherein said layer of resilient gripper material comprises a coherent continuous layer about 2 mils thick and said raised elements extend about 2 mils above said continuous layer.

21. The invention as in claim 1 wherein said layer of resilient gripper material is a thin coherent continuous layer of a resiliently compressible non-tacky material having a predetermined thickness; said engagement pressure is within a predetermined range; and said thickness of said gripper material is correlated with said range of engagement pressure to provide sufficient compressability for substantially uniform application of said engagement pressure to said material.

22. An improved indexable multi-layer coated abrasive material comprising:

at least one first base layer of a non-compressible, non-stretchable material provided with an upper surface and a lower surface;

at least one binder layer of a resiliently compressible material provided with a first surface and a second surface, the first surface of the binder layer in permanent, confirming engagement with the lower surface of the base layer;

at least one adhesive layer of a substantially insoluble resinous material coating and conforming to the second surface of the binder layer;

at least one layer of finely divided abrasive particles partially and substantially permanently embedded in the adhesive layer; and at least one second backing layer of a resilient, non-tacky gripper material provided with an inner face in permanent, conforming engagement with the upper surface of the base layer and an outer face having resilient textured pattern formed thereon; said outer face presenting an outwardly exposed, readily releasable griping surface for frictionally and releasably engaging holding means when said holding means are pressed against said exposed surface and for ready release from said holding means for slidable selective movement of said abrasive material when the engagement pressure therebetween is released.

23. The invention as in claims 1 or 22 wherein said abrasive material comprises a long narrow strip for use in automated, indexable polishing apparatus.

* * * * *

UNITED STATES PATENT AND TRADEMARK OFFICE

CERTIFICATE OF CORRECTION

PATENT NO. : 5,109,638

DATED : MAY 5, 1992

INVENTOR(S) : Byron L. Kime, Jr.

It is certified that error appears in the above-identified patent and that said Letters Patent is hereby corrected as shown below:

Column 10, line 9, "between - 15 to 31 3 degrees" should read -- between -15 to -3 degrees --;

Column 10, line 20, "resiliently" should read --resilient--;

Column 10, line 23, "region" should read --resin--;

Column 11, line 15, "confirming" should read --conforming--; and

Column 12, line 10, delete "griping" should read --gripping--.

Signed and Sealed this

Tenth Day of August, 1993

*Attest:*

Michael K. Kirk

MICHAEL K. KIRK

*Attesting Officer*

*Acting Commissioner of Patents and Trademarks*